United States Patent [19]

Swanson

[11] 4,288,657

[45] Sep. 8, 1981

[54] FREE-SPRING WIRE CONNECTOR

[75] Inventor: Arthur F. Swanson, DeKalb, Ill.

[73] Assignee: International Telephone and Telegraph Corporation, New York, N.Y.

[21] Appl. No.: 135,511

[22] Filed: Mar. 31, 1980

[51] Int. Cl.[3] ..... H01R 4/22

[52] U.S. Cl. ..... 174/87

[58] Field of Search ..... 174/87

[56] References Cited

U.S. PATENT DOCUMENTS

| | | | |
|---|---|---|---|
| 3,075,038 | 1/1963 | Schinske | 174/87 |
| 3,308,229 | 3/1967 | Burniston | 174/87 |
| 3,497,607 | 2/1970 | Swanson | 174/87 |
| 3,519,707 | 7/1970 | Krup | 174/87 X |

*Primary Examiner*—Elliot A. Goldberg
*Assistant Examiner*—D. A. Tone
*Attorney, Agent, or Firm*—James B. Raden; William J. Michals

[57] ABSTRACT

A twist-on connector for electrical wires and the like comprises a hollow plastic shell having an opening at one end, a generally perpendicular closed end wall at the other end thereof, and one or more wing-like torque applicator ribs extending generally radially outwardly in an oblique angular direction from the external surface of the shell. The torque applicator rib or ribs of such configuration to permit flexing or cushion action to applicator's fingers, or torque limiting means during tool application of connector. The inside surface of the shell is provided with a plurality of longitudinally inwardly extending ribs which function to funnel an insert spring which is threaded into the shell, and to reinforce the body of the shell. The inner end of the spring engages an insert torque applicator stop at the closed end of the shell which transfers the torsional forces applied to the shell body to the outer end of the insert spring. The inner side of the closed end wall includes a stepped surface defining two or more plane surfaces of differing height. The stepped surface reacts against the wire bundle ends inserted through the insert spring to provide a torque variation on the wire bundle ends forcing the wire ends out of alignment with the bundle diameter and beyond the diameter of the inner end of the insert spring. This "wiping-over" or clinching effect significantly increases the torque required to remove the installed connector from a wire group. The unfavorably oblique angular position of the torque applicator ribs provides a deterrent to unauthorized removal of an installed connector from a wire group.

7 Claims, 6 Drawing Figures

FREE-SPRING WIRE CONNECTOR

BACKGROUND OF THE INVENTION

This invention relates to twist-on type wire connectors, and, more particularly, to such connectors which include a tapered coiled insert spring fastening element contained within a surrounding insulating shell.

These connectors are known and have been widely used in the art. The surrounding insulating shell may utilize localized interior threads for receiving and retaining the spring fastening element. The free-spring nature of the fastening element provides means for connecting various grouped wire diameters wherein the length of the spring decreases and moves further down into the shell cavity as the diameter increases thereby to accommodate larger wire bundle diameters. The present invention provides an improved free-spring wire connector which provides a unique "wiping-over" or clinching effect to the electrical conductors passing through the spring fastener which significantly increases the torque required to remove an installed connector from a wire bundle.

SUMMARY OF THE INVENTION

Briefly, a twist-on connector for connecting the stripped ends of a bundle of insulated wires is provided. The connector includes a hollow generally tubular shell of plastic material having an opening at one end thereof and a closed end wall at the other end thereof which is generally perpendicular to the longitudinal axis of the shell. A plurality of circumferentially spaced and longitudinally extending ribs on the inner surface of the shell are provided which extend from points adjacent the opening toward the central portion of the shell. A coiled insert spring which is wound from a wire having a generally polygonal cross-sectional area is provided. The coiled insert spring provides an edge on at least the external surface of the coiled spring and the coiled spring is inserted into the shell by threading the coil spring into the shell. A stop member is positioned along a peripheral portion of the end wall for engaging the free inner end of the coiled spring for transferring external torsional forces applied to the shell to the other end of the coil spring. The inner side of the end wall includes a stepped transition portion between areas of differing longitudinal dimensions which provide a differential torque distribution to the wire bundle ends projecting through the open inner end of the coiled spring, thereby to alter the initial alignment of the wire ends relative the bundle diameter and into a diameter which significantly exceeds the diameter of the inner end of the coiled spring.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
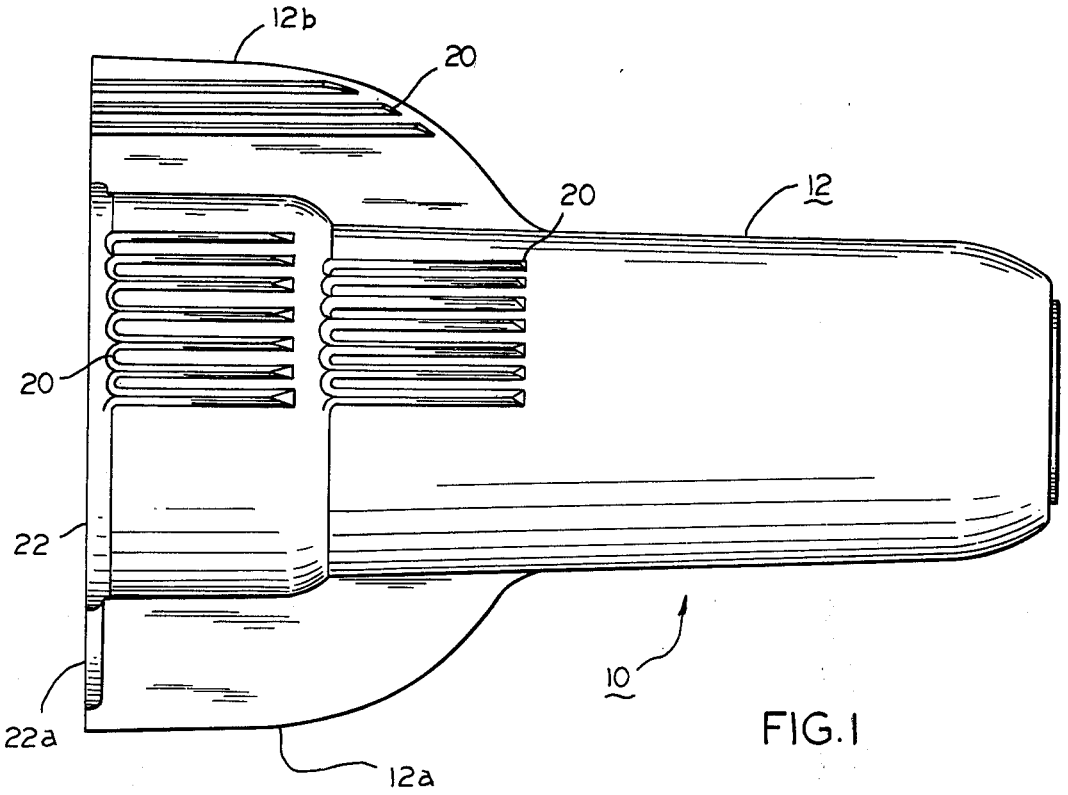
FIG. 1 is a plan side view of the connector shell in accordance with the present invention.
Figure 2:
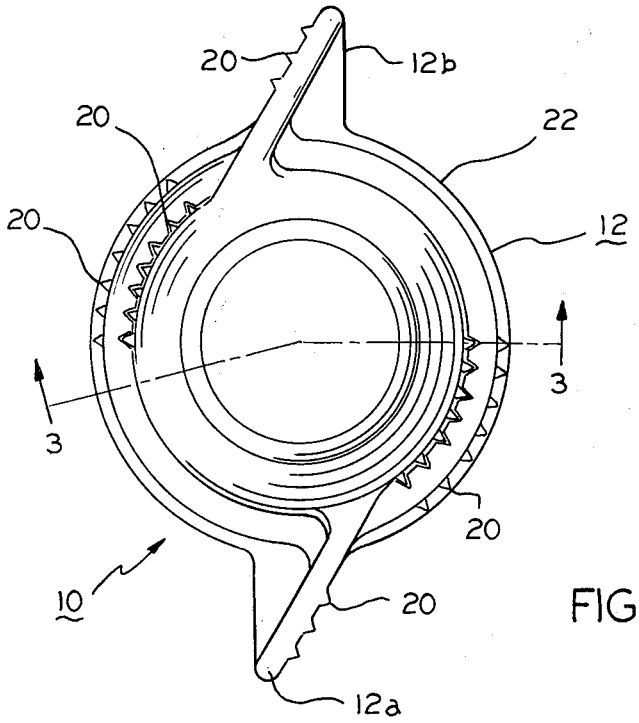
FIG. 2 is an end view of the connector shell of FIG. 1.

Referring now to FIGS. 1 and 2 there are shown plan and end views of the insulating connector shell of the free-spring wire connector 10 in accordance with the present invention. Connector 10 includes a pair of wings or ribs 12*a* and 12*b* which intersect the shell body 12 at an angle as illustrated in FIG. 2. The radially inner portions of ribs 12*a* and 12*b* provide exterior longitudinal reinforcement of the shell body thereby preventing longitudinal collapsing of the shell body. The wing ribs 12*a* and 12*b* are further provided with a series of reinforcing and gripping ribs 20 as is the main portion of the shell body. The opened end of the shell is provided with a reinforcing lip ring 22 which reinforces the opening and extends toward the end of wing ribs 12*a* and 12*b* as illustrated at 22*a*.

Figure 3:
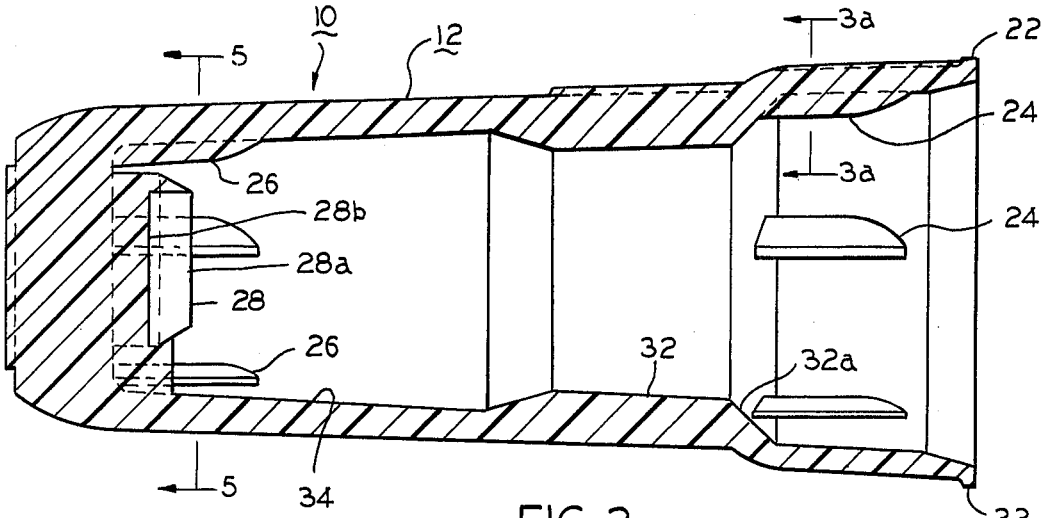
FIG. 3 is a longitudinal sectional view of the connector shell of the previous drawing figures and FIG. 3*a* is a view taken along the lines 3*a*—3*a* of FIG. 3.
Figure 3A:
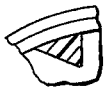

Referring now to FIG. 3 there is shown a longitudinal sectional view of the connector shell in accordance with the present invention. The internal portion of shell body 12 is provided with a plurality of longitudinally extending ribs 24 which extend from near the shell opening to the end of the skirt area of the shell body. In a preferred embodiment of the present invention connector 10 includes five circumferentially equally spaced ribs 24. Ribs 24 blend into shell body 12 at the open end of the shell body to provide means for funnelling a wire bundle into connector 10. Ribs 24 are provided with an inclined or tapered cross section, as best illustrated in FIG. 3*a*, which provides an inclined leading edge configuration that easily slides over inserted wire insulation bundle diameters during the assembly of connector 10 to the various wire bundle diameters. The trailing end of ribs 24 provides an abrupt discontinuity so as to provide a locking surface against the wire insulation bundle surface when attempts are made to remove the wire connector as by reversing the rotation of the shell. Ribs 24 also provide means for reinforcing the relatively thin shell skirt area, thereby preventing the skirt area of shell body 12 from collapsing.

Figure 4:
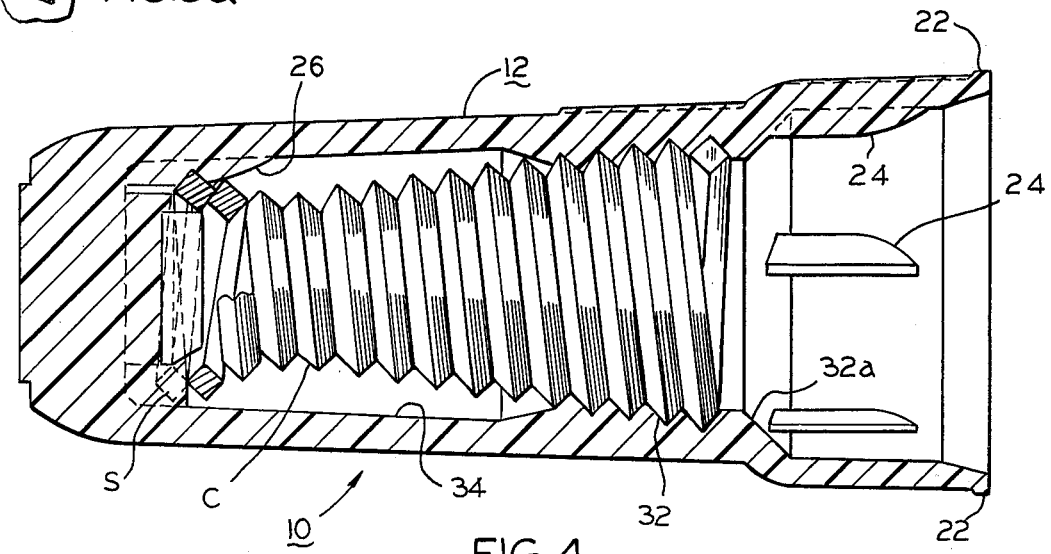
FIG. 4 is a similar longitudinal sectional view illustrating the placement of the coil spring or fastening element therein; and, FIG. 5 is a cross-sectional view taken along the lines 5—5 of FIG. 3 and illustrating structural features in accordance with the principles of the present invention.
Figure 5:
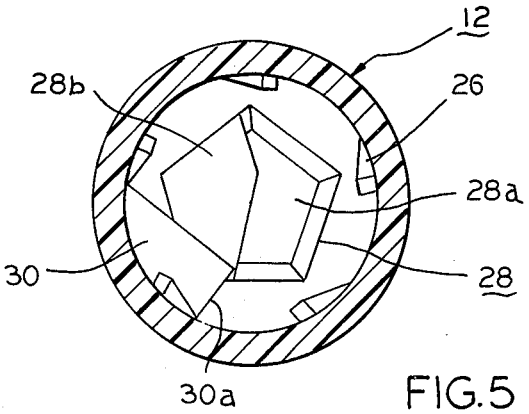

The inner end of the internal wall surface of shell body 12 is further provided with a second plurality of longitudinally extending ribs 26 which extend longitudinally outwardly from the closed end of shell body 12. As best illustrated in FIG. 5, the inner end of shell body 12 is provided with a differential contact surface 28 which includes plane surfaces 28*a* and 28*b* of a stepped configuration wherein the surfaces are provided of differing heights or longitudinal dimensions as will be explained more fully hereinafter. The inner end of shell body 12 further includes a stop means 30 which functions to engage the leading or cut-off end of the coil spring or fastening element as illustrated somewhat more clearly in FIG. 4. It can be seen by reference to FIG. 4 that a tapered coil spring C is provided and which threadedly engages a series of threads which are preformed or provided along reinforcing portion 32 of shell body 12. The threads in the surface of portion 32 can also be formed by the cutting action of the sharp edges of the polygonal cross section of the wire which forms coil spring C and during the initial insertion process. That is, if desired, coil spring C can be threaded into shell body 12 by cutting its own threads or the threaded portions can be preformed, as desired. It can be seen by reference to FIG. 4 that the internal portion of shell body 12, which resides between the end portion and the reinforcing portion 32, preferably includes a cavity portion 34 which accommodates the increasing diameter of coil spring C as the coil spring is rotated about larger conductor bundle diameters. It can also be seen that the leading or cut-off end S of coil spring C engages a flattened portion 30*a* of stop 30. This structure provides the primary means for transmitting to the cut-off end S of coil spring C the torsional forces applied to the wing ribs 12*a* and 12*b* of the connector body 12.

As previously alluded to, the inner side of the closed end wall of shell body 12 includes a stepped transition surface defining two or more plane surfaces of differing height so as to provide a torque variation on the wire bundle ends during the installation of connector 10 onto a wire bundle end, thereby forcing the wire ends out of alignment with the bundle diameter and beyond the diameter of the inner end of the insert spring C. This wiping-over or clinching effect significantly increases the torque required to remove the installed connector from a wire bundle.

What has been taught, then, is a free-spring wire connector facilitating, notably, easy installation over wire bundle ends while providing increased resistance to attempted or undesired removal of the connector from the connected wire ends. The form of the invention illustrated and described is but a preferred embodiment of these teachings in a form currently preferred for manufacture. It is shown as an illustration of the inventive concepts, however, rather than by way of limitation and it is pointed out that various modifications and alterations may be indulged in within the scope of the appended claims.

What is claimed is:

1. A twist-on connector for connecting the stripped ends of a bundle of insulated wires comprising, in combination:

a hollow generally tubular shell of plastic material having an opening at one end thereof and a closed end wall at the other end thereof which is generally perpendicular to the longitudinal axis of said shell;

a plurality of circumferentially spaced and longitudinally extending ribs on the inner surface of said shell and extending from points adjacent said opening toward the central portion of said shell;

a coiled spring wound from a wire having a generally polygonal cross-sectional area which provides an edge on at least the external surface of said coiled spring, and said coil spring being inserted into said shell by threading said coil spring into said shell;

a stop member positioned along a peripheral portion of said end wall for engaging the free inner end of said coil spring for transfering external torsional forces applied to said shell to the other end of said coil spring; and, the inner side of said end wall having a stepped transition portion between areas of differing longitudinal dimensions which provide a differential torque distribution to the wire bundle ends projecting through the open inner end of said coil spring, thereby to alter the initial alignment of the wire ends relative to the bundle diameter and into a diameter which exceeds the diameter of the inner end of said coil spring.

2. The connector according to claim 1, wherein the cross-sectional area of said ribs is tapered downwardly in the direction of installation rotation of said shell wherein the trailing ends of said tapered portions provide an abrupt discontinuity to resist the reversed rotation of an installed connector.

3. The connector according to claim 2, wherein said shell includes a second plurality of ribs on the inner surface of said shell extending from said end wall to an intermediate portion of said shell for reinforcing the inner end portion of said shell and for threadedly engaging the inner end portion of said coil spring.

4. The connector according to claim 3, wherein said shell includes a reinforcing band between and separating said first and second plurality of ribs and being formed of a radially thickened portion of said shell and wherein said coil spring threadedly engages said reinforcing band as the length of said coil spring decreases from its static length in response to the installation of said connector onto a wire bundle having a diameter significantly greater than the intermediate diameter of said coil spring.

5. The connector according to claim 4, wherein said shell includes an inclined surface between said first plurality of ribs and said reinforcing band to funnel the blunt ends of said wire bundle ends into said other end of said coil spring.

6. The connector according to claim 5, wherein said shell includes a pair of external wing-like members extending from opposite sides of the outer surface of said shell and in planes defined by a pair of generally parallel cords of a central cross section of said tubular shell.

7. The connector according to claim 6, wherein said shell includes a second inclined surface from said opening at said one end of said shell to a point adjacent the outer points of the first plurality of ribs on the inner surface of said shell to funnel said wire bundle ends into said shell.

* * * * *